US009578930B2

(12) United States Patent
Koreishi

(10) Patent No.: US 9,578,930 B2
(45) Date of Patent: Feb. 28, 2017

(54) BUCKLE

(71) Applicant: NIFCO INC., Yokosuka-shi, Kanagawa (JP)

(72) Inventor: Namiko Koreishi, Yokosuka (JP)

(73) Assignee: NIFCO INC., Yokosuka-Shi, Kanagawa (JP)

( * ) Notice: Subject to any disclaimer, the term of this patent is extended or adjusted under 35 U.S.C. 154(b) by 52 days.

(21) Appl. No.: 14/419,391

(22) PCT Filed: Aug. 7, 2013

(86) PCT No.: PCT/JP2013/004774
§ 371 (c)(1),
(2) Date: Feb. 3, 2015

(87) PCT Pub. No.: WO2014/024489
PCT Pub. Date: Feb. 13, 2014

(65) Prior Publication Data

US 2015/0201713 A1 Jul. 23, 2015

(30) Foreign Application Priority Data

Aug. 7, 2012 (JP) ..... 2012-175002

(51) Int. Cl.
*A44B 11/26* (2006.01)
*A44B 11/25* (2006.01)
*A44B 11/00* (2006.01)

(52) U.S. Cl.
CPC ..... *A44B 11/266* (2013.01); *A44B 11/006* (2013.01); *A44B 11/2511* (2013.01);
(Continued)

(58) Field of Classification Search
CPC . A44B 11/2511; A44B 11/263; A44B 1/0061; Y10T 24/45623; Y10T 24/45639; Y10T 24/45644; Y10T 24/4086
See application file for complete search history.

(56) References Cited

U.S. PATENT DOCUMENTS 5,263,234 A * 11/1993 Fudaki ..... A44B 11/263 24/615
D702,593 S * 4/2014 Koreishi ..... D11/216
(Continued)

FOREIGN PATENT DOCUMENTS

JP H06-119 U 1/1994
JP H08-103306 A 4/1996

OTHER PUBLICATIONS

PCT, "International Search Report for PCT/JP2013/004774".

*Primary Examiner* — Robert J Sandy
*Assistant Examiner* — Michael Lee
(74) *Attorney, Agent, or Firm* — Manabu Kanesaka

(57) ABSTRACT

A buckle having an excellent design property is provided.
[Solution] In a buckle for a belt in which a socket member and a plug member engage with each other, a buckle 10 is formed by forming the socket member including a front face portion 25 having an approximately flat surface; a back face portion 26 provided in such a way as to face a reverse face of the front face portion 25, and forming an engagement hole 21 with which the plug member engages between the back face portion 26 and the front face portion 25; a pressing piece 28 formed in the front face portion 25 by being divided by a slit 31 formed in the front face portion 25 and pressed for releasing an engagement with the plug member inserted into the engagement hole 21 to be engaged therewith; and a hinge portion 29 formed to be thinner than the pressing piece 28, connecting the pressing piece 28 to the same surface as the surface of the front face portion 25, and serving as a base point for a displacement when the pressing piece 28 is pressed.

3 Claims, 4 Drawing Sheets

(52) U.S. Cl.
CPC ..... *A44B 11/263* (2013.01); *Y10T 24/4086* (2015.01); *Y10T 24/45639* (2015.01)

(56) References Cited

U.S. PATENT DOCUMENTS

2004/0221432 A1* 11/2004 Nezu ..... A44B 11/263 24/614
2007/0214617 A1* 9/2007 Niwa ..... A44B 11/263 24/615

* cited by examiner

BUCKLE

RELATED APPLICATIONS

The present application is National Phase of International Application No. PCT/JP2013/004774 filed Aug. 7, 2013, and claims priority from Japanese Application No. 2012-175002, filed Aug. 7, 2012, the disclosure of which is hereby incorporated by reference herein in its entirety.

FIELD OF TECHNOLOGY

The present invention relates to a buckle used for a belt or a strap.

BACKGROUND ART

Conventionally, a buckle is used when both end portions of a belt binding a baggage or the like are connected, or when an ID card or a cellular phone and a strap for suspending the ID card or the cellular phone from one's neck are connected. As such a buckle, for example, a buckle, described in the following Patent Document 1 is proposed.

The buckle is formed by a male member and a female member mutually engaging. In the female member, there is formed an operation portion for releasing an engagement with the male member. The operation portion is formed by a C-shaped slit formed on a surface of the female member, and also a groove portion having a concave strip in a cross-sectional view formed on a surface of the female member in the same manner. The groove portion is provided between both ends of the C-shaped slit to form a thin hinge portion. The operation portion moves up and down as a supporting point of the thin hinge portion. Also, in the operation portion, one portion protrudes more than the surface of the female member, so that one's fingers are easily placed so as to facilitate an operation.

PRIOR ART DOCUMENT

Patent Document

Patent Document 1: Japanese Patent No. 3992194

SUMMARY OF THE INVENTION

Problems to be Solved by the Invention

According to the aforementioned buckle, however, in the female member, the groove portion forming the thin hinge portion of the operation portion is formed on the surface, and one portion of the operation portion protrudes more than the surface of the female member, so that concave and convex portions are formed on the surface. Therefore, it is difficult to incorporate a design on the surface of the female member.

The present invention is proposed in view of the aforementioned circumstance. Namely, an object of the present invention is to provide a buckle excellent in a design property.

Means for Solving the Problems

In order to obtain the aforementioned object, a buckle according to the present invention includes a plug member provided at one end portion of a belt, and a socket member provided at the other end portion of the belt, with which the plug member is engaged. The socket member includes a front face portion having an approximately flat surface; a back face portion provided in such a way as to face a reverse face of the front face portion, and forming an engagement hole with which the plug member is engaged between the back face portion and the front face portion; a pressing piece formed in the front face portion by being divided by a slit formed in the front face portion, and pressed for releasing an engagement with the plug member inserted into the engagement hole to be engaged therewith; and a hinge portion formed to be thinner than the pressing piece, connecting the pressing piece to the same surface as the surface of the front face portion, and serving as a base point for a displacement when the pressing piece is pressed.

Also, in the buckle, in order to form the hinge portion to be thinner than the pressing piece, a groove portion is formed on the reverse face of the front face portion, and in the back face portion, there is formed a through-hole at a portion where the groove portion is projected on the back face portion.

Also, in the buckle, on a side opposite to an opening side of the engagement hole, there are formed a belt-wrapping portion for wrapping the belt, and a circulating passage where the belt passes around the belt-wrapping portion, and the circulating passage is integrated with the through-hole.

Also, in the buckle, on the side opposite to the opening side of the engagement hole, there are formed a belt-wrapping portion for wrapping the belt, and a circulating passage where the belt wraps around the belt-wrapping portion, and the circulating passage is formed toward the back face portion side from the front face portion side.

Effect of the Invention

The buckle according to the present invention has the aforementioned structure. According to the structure, in the front face portion of the socket member which is a front face of the buckle, the slit is located close to an edge of a shape of the front face portion along the shape of the front face portion, so that the pressing piece is widely obtained, and is flat. Therefore, a design surface on which a design is applied can be ensured at the maximum in the front face of the buckle so as to improve a design property.

Especially, in the buckle, in order to form the hinge portion thinner than the pressing piece, the groove portion is formed on the reverse face of the front face portion, and the through-hole is formed on the back face portion including a projection surface where the groove portion is projected on the back face portion. According to the structure, while ensuring a flexibility of the hinge portion, the surface of the front face portion is flat. Therefore, the design surface on which the design is incorporated can be ensured at the maximum in the front face of the buckle so as to improve the design property. Also, regarding a molding of the groove portion, a die at a time of molding can be easily cut out through the through-hole so as to improve workability at the time of molding.

Especially, in the buckle, on the side opposite to the opening side of the engagement hole, there are formed the belt-wrapping portion for wrapping the belt, and the circulating passage where the belt passes around the belt-wrapping portion, and the circulating passage is integrated with the through-hole. According to the structure, the circulating passage is also used as the through-hole allowing the die to be easily cut out at the time of molding. Therefore, the workability at the time of molding can be improved.

Especially, in the buckle, the circulating passage is formed toward the back face portion side from the front face portion side. According to the structure, the circulating passage is linearly formed, and can be visually recognized from the front face portion side. Therefore, the belt can be easily passed through the circulating passage, can be easily wrapped to the belt-wrapping portion, and can be easily adjusted when the belt is wrapped.

BRIEF DESCRIPTION OF THE DRAWINGS

FIG. 1(*b*) is a front view; FIG. 1(*c*) is a right side view; FIG. 1(*d*) is a side view; and FIG. 1(*e*) is a back view.

FIG. 2(*b*) is a front view; FIG. 2(*c*) is a right side view; FIG. 2(*d*) is a side view; and FIG. 2(*e*) is a back view.

FIG. 3(*b*) shows a side sectional view taken along a line A-A.

FIG. 4(*b*) is a right side view; FIG. 4(*c*) is a side view; and FIG. 4(*d*) shows a side sectional view taken along a line C-C.

FIG. 5(*b*) shows a side sectional view taken along a line D-D.

BEST MODES OF CARRYING OUT THE INVENTION

Figure 1A:
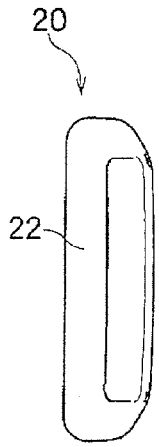
FIGS. 1(*a*) to 1(*e*) show a buckle according to the first embodiment of the present invention, wherein FIG. 1(*a*) is a left side view.
Figure 1B:
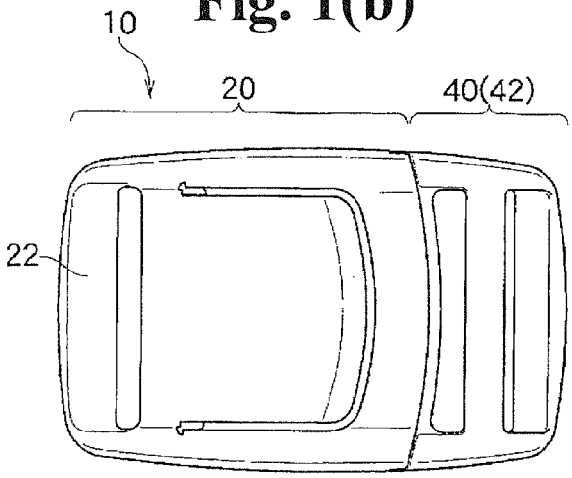
Figure 1C:
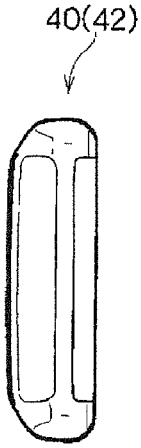
Figure 1D:
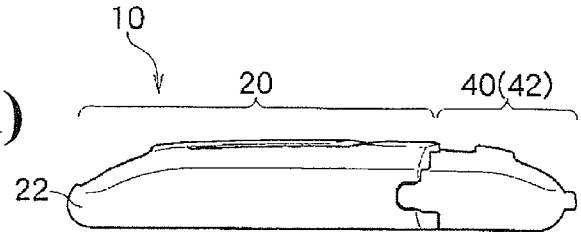
Figure 1E:
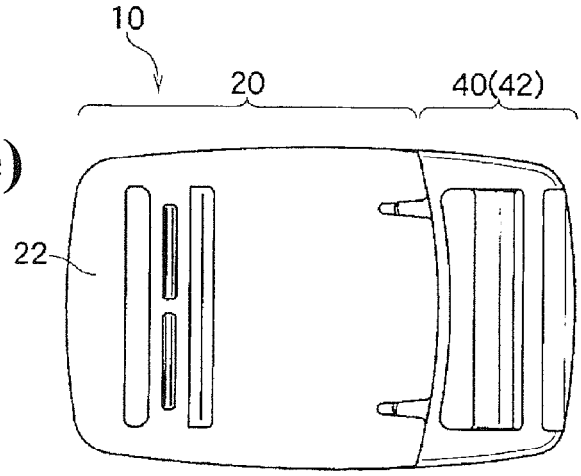
Figure 2A:
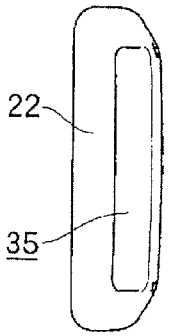
FIGS. 2(*a*) to 2(*e*) show a socket member of the buckle according to the first embodiment of the present invention, wherein FIG. 2(*a*) is a left side view.
Figure 2B:
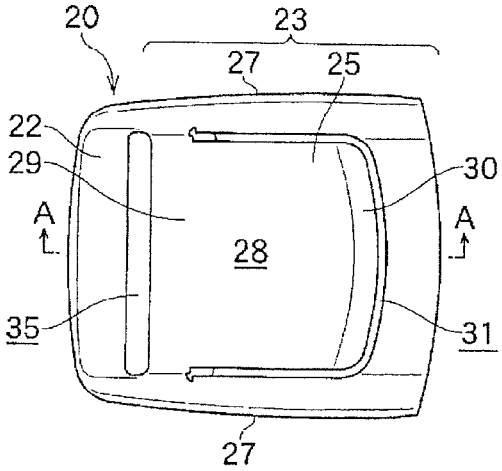
Figure 2C:
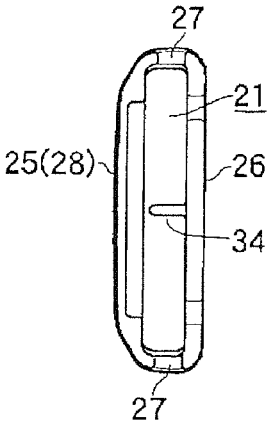
Figure 2D:
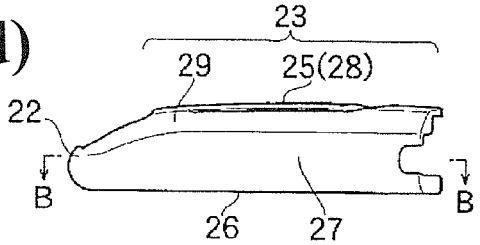
Figure 2E:
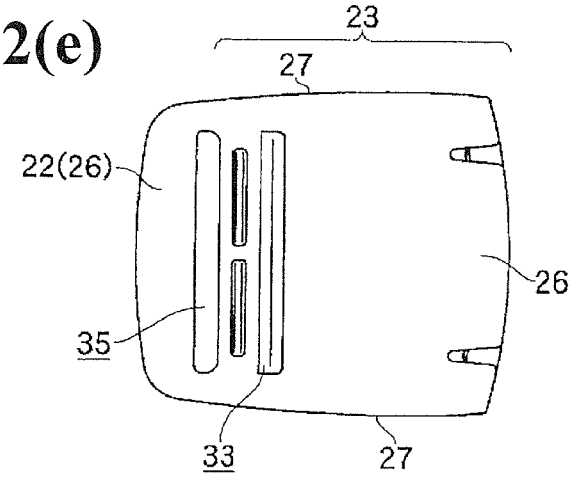

Hereinafter, the first embodiment of the present invention will be explained based on the drawings. FIGS. 1(*a*) to 1(*e*) show a buckle 10 according to the first embodiment.

In FIGS. 1(*a*) to 1(*e*), the buckle 10 according to the first embodiment has an approximately flattened square shape. In the buckle 10, a design such as, for example, a logotype, a pattern, or the like, is applied on a front face, and a belt is wrapped to belt-wrapping portions 22 and 42 formed on right and left sides. The belt is not shown in the drawings. The buckle 10 is formed by a plug member 40 to which one end portion of the belt is wrapped; and a socket member 20 to which the other end portion is wrapped, and each of the members 40 and 20 is connected to be formed. The plug member 40 and the socket member 20 are detachable.

Next, the socket member 20 will be explained based on FIG. 2(*a*) to FIG. 3(*b*). FIGS. 2(*a*) to 2(*e*) show exteriors of the socket member 20, and FIGS. 3(*a*) and 3(*b*) show cross sectionals of the socket member 20.

Figure 3A:
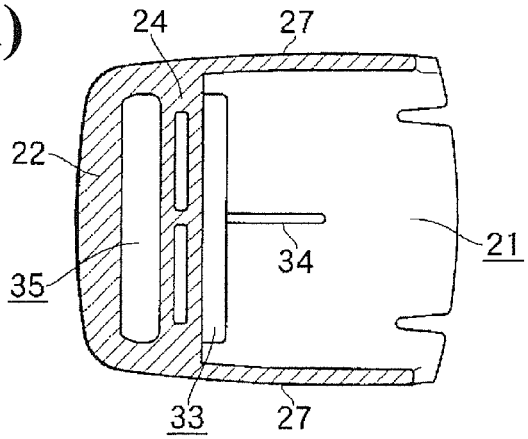
FIGS. 3(*a*) and 3(*b*) show cross-sectional views of the socket member, wherein FIG. 3(*a*) shows a front sectional view taken along a line B-B.
Figure 3B:
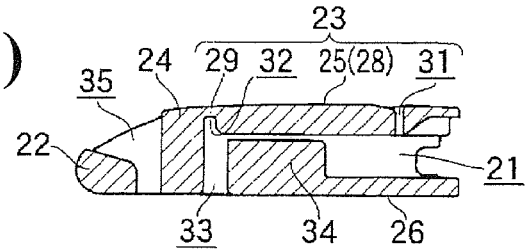
Figure 4B:
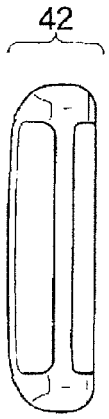
FIGS. 4(*a*) to 4(*d*) show a plug member of the buckle according to the first embodiment of the present invention, wherein FIG. 4(*a*) is a front view.
Figure 4A:
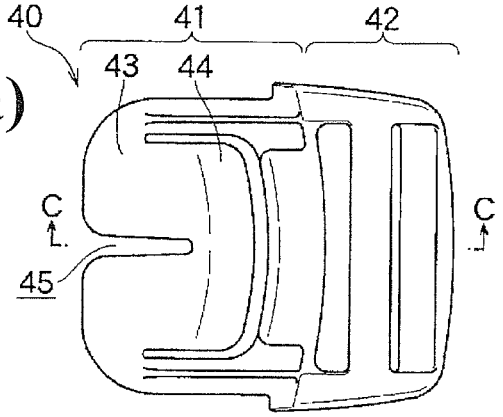
Figure 4C:
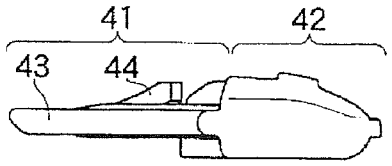
Figure 4D:
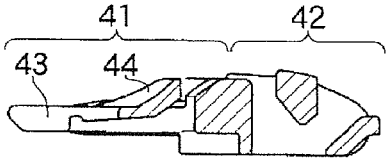

In FIG. 2(*a*) to FIG. 3(*b*), the socket member 20 is a flattened cylindrical shape of an approximately cuboid shape, and an engaged hole 21 into which the plug member 40 is inserted to be engaged therewith is formed on an inner side. The socket member 20 is formed by an engaged portion 23 in which the engaged hole 21 is formed; and a socket-side belt-wrapping portion 22 formed on a side opposite to an opening side of the engaged hole 21, to which the other end portion of the belt is wrapped. The engaged portion 23 and the socket-side belt-wrapping portion 22 are divided by a separation portion 24 (see FIG. 3(*b*)).

The engaged portion 23 is formed by a front face portion 25 including an approximately flat surface; a back face portion 26 facing a reverse face of the front face portion 25 through the engaged hole 21; side face portions 27 connecting both ends of the front face portion 25 and the back face portion 26; the engaged hole 21 formed by being surrounded by each face portion 25, 26, and 27; a pressing piece 28 formed in the front face portion 25; and a hinge portion 29 serving as a base point for a displacement when the pressing piece 28 is pressed.

The front face portion 25 includes a flat surface. There, "flat" means that extreme convex and concave portions are not formed on the surface, and that convex and concave portions are allowed provided that they have gentle ups and downs. Namely, the surface of the front face portion 25 may be flat provided that it is flat to a degree not to interfere when the design such as, for example, the logotype, the pattern, or the like is applied.

The pressing piece 28 is one portion of the front face portion 25, and is formed by being divided by an approximately U-shaped slit 31 formed on the surface along a shape of the front face portion 25. The pressing piece 28 has an approximately flat square shape, and includes the hinge portion 29 and a free end portion 30. The hinge portion 29 is located between end portions of the approximately U-shaped slit 31 on the surface of the front face portion 25, and is connected to the same surface as a socket-side belt-wrapping portion 22 side to be approximately flat. The hinge portion 29 is formed to be thinner than the pressing piece 28 by a line of a groove portion 32 formed on the reverse face of the front face portion 25 (see FIG. 3(*b*)). The free end portion 30 is separated from the front face portion 25 by the slit 31 on the opening side of the engaged hole 21.

Incidentally, the slit 31 is not limited to an approximately U shape provided that the slit 31 is formed close to an edge of the shape of the front face portion 25 along the shape of the front face portion 25. Accordingly, the shape of the pressing piece 28 is not limited to an approximately square shape as well. Namely, the slit 31 and the pressing piece 28 may have a shape provided that it ensures a wide space range in which the design such as, for example, the logotype, the pattern, or the like is applied on the surface of the front face portion 25. A surface (an outer face) of the pressing piece 28 which is one side divided by the slit 31; and a surface (an outer face) of an edge portion of the front face portion 25 which is the other side, are disposed in one continuous virtual face shape. The virtual face may be a flat surface, or may be a curved surface such as a convex surface or a concave surface. In other words, a face, wherein the surface (the outer face) of the pressing piece 28 which is one side divided by the slit 31 is externally inserted, is formed in such a way as to coincide with the surface (the outer face) of the edge portion of the front face portion 25 which is the other side.

The back face portion 26 extends to the side opposite to the opening side of the engaged hole 21 more than the front face portion 25 (see FIG. 2(*d*)). In the back face portion 26, there is formed a through-hole 33 near the separation portion 24, which is formed at a boundary between the back face portion 26 and the socket-side belt-wrapping portion 22. An opening portion of the through-hole 33 has a rectangular shape, and faces the groove portion 32 formed on a reverse side of the front face portion 25 (see FIG. 3(*b*)). Namely, the through-hole 33 is formed within a range including a projection of the groove portion 32 projected on the back face portion 26. Specifically, the groove portion 32 projected on the back face portion 26 is entirely disposed inside the through-hole 33. In the back face portion 26, there is formed a guide rib 34 on a face facing the reverse face of the front face portion 25. The guide rib 34 is a plate-like piece, and is provided to stand approximately from a center of the back face portion 26 to be parallel to the side face portions 27.

The socket-side belt-wrapping portion 22 is formed by a circulating passage 35 passing through the back face portion 26. The socket-side belt-wrapping portion 22 has a rod shape, and both ends are connected to the back face portion 26 of the engaged portion 23. The circulating passage 35 is located inside of the socket-side belt-wrapping portion 22 and the back face portion 26 of the engaged portion 23, and the belt passes through when the belt is wrapped around the socket-side belt-wrapping portion 22. The circulating passage 35 is linearly formed toward a back face portion 26 side from a front face portion 25 side of the engaged portion 23.

Next, the plug member 40 will be explained based on FIGS. 4(*a*) to 4(*d*). FIGS. 4(*a*) to 4(*d*) show the plug member 40.

In FIGS. 4(*a*) to 4(*d*), the plug member 40 has an approximately cuboid shape, and is formed by an engagement portion 41 inserted into the socket member 20 to be engaged therewith; and a plug-side belt-wrapping portion 42 formed on a side opposite to the engagement portion 41, to which one end portion of the belt is wrapped.

The engagement portion 41 is formed by a plate-like engagement piece 43, and a claw portion 44 connected to a surface of the engagement piece 43. The engagement piece 43 has a size of being housed in the engaged hole 21 of the socket member 20, and a guide slit 45 is formed approximately at a center. The guide slit 45 is formed in an insertion direction of the engagement portion 41, and has a size in which the guide rib 34 of the socket member 20 can be housed. The claw portion 44 is connected to a tip of the engagement piece 43, and gradually warps upward toward a plug-side belt-wrapping portion 42 side formed on a side opposite to the tip.

In the aforementioned manner, the plug member 40 and the socket member 20 are formed. The buckle 10 is formed in such a way that the engagement piece 43 of the plug member 40 is inserted into the engaged hole 21 of the socket member 20 to be engaged therewith. In the plug member 40, the guide slit 45 is guided to the guide rib 34 of the socket member 20, and the claw portion 44 bends and is locked in the slit 31 inside the engaged hole 21 of the socket member 20. In the buckle 10, the pressing piece 28 of the socket member 20 is pressed, the claw portion 44 of the plug member 40 is released from the slit 31 to be disengaged, and the engagement portion 41 of the plug member 40 is extracted from the engaged hole 21 of the socket member 20 to be detached.

Next, an effect of the first embodiment will be explained.

As mentioned above, according to the first embodiment, the pressing piece 28 is one portion of the front face portion 25, and is formed by being divided by the approximately U-shaped slit 31 formed on the surface along the shape of the front face portion 25. The hinge portion 29 of the pressing piece 28 is located between the end portions of the approximately U-shaped slit 31 on the surface of the front face portion 25, and is flatly connected to the socket-side belt-wrapping portion 22 side. The hinge portion 29 is formed to be thinner than the pressing piece 28 by the line of the groove portion 32 formed on the reverse face of the front face portion 25.

According to the structure, in the front face portion 25 of the socket member 20, which is the front face of the buckle 10, the slit 31 is located close to the edge of the shape of the front face portion 25 along the shape of the front face portion 25, so that the pressing piece 28 is widely obtained, and is flat without concave and convex portions due to the hinge portion 29 and the like. Therefore, a design surface on which a design is applied can be ensured at the maximum in the front face of the buckle 10 so as to improve a design property.

According to the first embodiment, in the back face portion 26, there is formed the through-hole 33 facing the groove portion 32 formed at the reverse side of the front face portion 25. Namely, the through-hole 33 is formed within the range including the projection of the groove portion 32 projected on the back face portion 26.

According to the structure, regarding a molding of the groove portion 32, a die at a time of molding can be easily cut out through the through-hole 33 so as to improve a workability at the time of molding.

According to the first embodiment, the circulating passage 35 is the annular inside formed by the socket-side belt-wrapping portion 22 and the back face portion 26 of the engaged portion 23, and the belt is passed through when the belt circles around the socket-side belt-wrapping portion 22. The circulating passage 35 is linearly formed toward the back face portion 26 side from the front face portion 25 side of the engaged portion 23.

According to the structure, the circulating passage 35 is linearly formed, and can be visually recognized from the front face portion 25 side. Therefore, the belt can be easily passed through the circulating passage 35, can be easily wrapped to the socket-side belt-wrapping portion 22, and can be easily adjusted when the belt is wrapped.

Figure 5A:
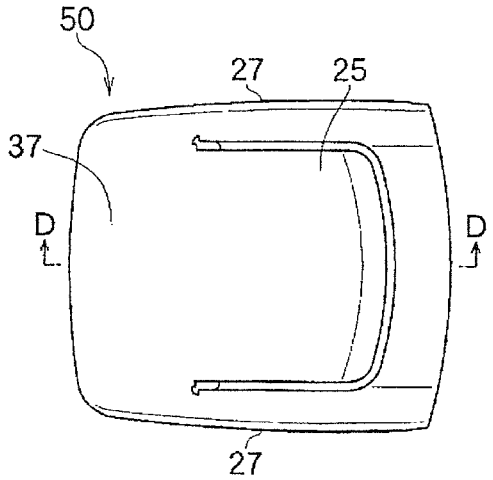
FIGS. 5(*a*) and 5(*b*) show the buckle according to a second embodiment of the present invention, wherein FIG. 5(*a*) is a front view.
Figure 5B:
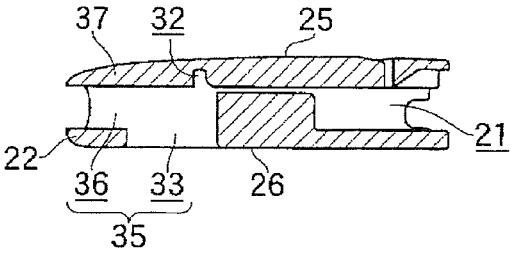

Next, a second embodiment of the present invention will be explained based on the drawings. FIGS. 5(*a*) and 5(*b*) show a socket member 50 of the buckle according to the second embodiment of the present invention. Incidentally, only a structure different from the structure of the first embodiment will be explained.

In FIGS. 5(*a*) and 5(*b*), in the front face portion 25 of the engaged portion 23, an extension face portion 37 extends to the side opposite to the opening side of the engaged hole 21, and an end of the extension face portion 37 is aligned on the end of the socket-side belt-wrapping portion 22. On the side of the socket-side belt-wrapping portion 22, there is formed a lateral hole 36 surrounded by the extension face portion 37, the side face portions 27, and the socket-side belt-wrapping portion 22. In the back face portion 26, there is formed the through-hole 33 orthogonal to the lateral hole 36. The through-hole 33 faces the groove portion 32 formed on the reverse side of the front face portion 25. Namely, the through-hole 33 is formed within the range including the projection of the groove portion 32 projected on the back face portion 26. The circulating passage 35 is formed by the lateral hole 36 and the through-hole 33.

Next, an effect of the second embodiment will be explained.

As mentioned above, according to the second embodiment, in the front face portion 25 of the engaged portion 23, the extension face portion 37 extends to the side opposite to the opening side of the engaged hole 21, and the end of the extension face portion 37 is aligned on the end of the socket-side belt-wrapping portion 22. By the structure, the surface of the front face portion 25 is extended by the extension face portion 37. Therefore, the design surface on which the design is incorporated can be ensured at the maximum in the front face of the buckle so as to improve the design property.

According to the second embodiment, the lateral hole 36 is formed by being surrounded by the extension face portion 37, the side face portions 27, and the socket-side belt-wrapping portion 22. In the back face portion 26, there is formed the through-hole 33 orthogonal to the lateral hole 36. The through-hole 33 faces the groove portion 32 formed at the reverse side of the front face portion 25. Namely, the through-hole 33 is formed within the range including the projection of the groove portion 32 projected on the back face portion 26. The circulating passage 35 is formed by the lateral hole 36 and the through-hole 33.

According to the structure, the circulating passage 35 is also used as the through-hole 33 allowing the die to be easily cut out at the time of molding. Therefore, the workability at the time of molding can be improved.

As mentioned above, the embodiments of the present invention have been described in detail; however, the present invention is not limited to the aforementioned embodiments. In the present invention, various design modifications can be carried out provided that they do not exceed the subject described in claims of the present invention.

EXPLANATION OF SYMBOLS

10 a buckle
20 and 50 socket members
21 an engaged hole
22 a socket-side belt-wrapping portion
23 an engaged portion
24 a separation portion
25 a front face portion
26 a back face portion
27 a side face portion
28 a pressing piece
29 a hinge portion
30 a free end portion
31 a slit
32 a groove portion
33 a through-hole
34 a guide rib
35 a circulating passage
36 a lateral hole
40 a plug member
41 an engagement portion
42 a plug-side belt-wrapping portion
43 an engagement piece
44 a claw portion
45 a guide slit

What is claimed is:

1. A buckle, comprising:

a plug member provided at one end portion of a belt; and a socket member provided at another end portion of the belt, engaging with the plug member;

wherein the socket member includes:

a front face portion having an approximately flat surface;

a back face portion provided in such a way as to face a reverse face of the front face portion, and forming an engagement hole with which the plug member is engaged, between the back face portion and the front face portion;

a pressing piece formed in the front face portion by being divided by a slit formed in the front face portion to be pressed for releasing an engagement with the plug member inserted into the engagement hole to be engaged therewith; and a hinge portion formed to be thinner than the pressing piece, connecting the pressing piece to a same surface as the surface of the front face portion, and serving as a base point for a displacement when the pressing piece is pressed, and a groove portion is formed on a reverse face of the front face portion in order to form the hinge portion to be thinner than the pressing piece, and in the back face portion, a through-hole is formed at a portion where the groove portion is projected on the back face portion.

2. A buckle according to claim 1, wherein a belt-wrapping portion for wrapping the belt is formed on a side opposite to an opening side of the engagement hole, and a circulating passage where the belt wraps around the belt-wrapping portion is formed, and the circulating passage is integrated with the through-hole.

3. A buckle according to claim 1, wherein a belt-wrapping portion for wrapping the belt is formed on a side opposite to an opening side of the engagement hole, and a circulating passage where the belt wraps around the belt-wrapping portion is formed, and the circulating passage is formed toward a back face portion side from a front face portion side.

* * * * *